United States Patent [19]

Thomas et al.

[11] Patent Number: 4,615,731

[45] Date of Patent: Oct. 7, 1986

[54] HYDROMETALLURGICAL PROCESSING OF PRECIOUS METAL-CONTAINING MATERIALS

[75] Inventors: John A. Thomas, Salvador, Brazil; Norman C. Nissen, Oakville, Canada; Malcolm C. E. Bell, Oakville, Canada; Alexander Illis, Mississauga, Canada

[73] Assignee: Inco Limited, Toronto, Canada

[21] Appl. No.: 578,630

[22] Filed: Feb. 9, 1985

Related U.S. Application Data

[63] Continuation of Ser. No. 304,264, Sep. 21, 1981.

[30] Foreign Application Priority Data

Sep. 30, 1980 [CA] Canada ..... 361246

[51] Int. Cl.[4] ..... C22B 11/04

[52] U.S. Cl. ..... 75/97 A; 204/108; 204/109; 75/99; 75/101 R; 75/108; 75/109; 75/112; 75/114; 75/115; 75/117; 75/118 R; 75/119; 75/120; 75/121; 423/22; 423/34; 423/38; 423/41; 423/42; 423/45; 423/92; 423/98; 423/87; 423/140; 423/150; 423/508; 423/509; 423/510

[58] Field of Search ..... 75/99, 97 A, 108, 114, 75/109, 115, 121, 112, 101 R, 119, 120; 423/508, 509, 510, 22, 34, 38, 41, 42, 45, 92, 98, 87, 140, 150; 204/108, 109

[56] References Cited

U.S. PATENT DOCUMENTS

| | | | |
|---|---|---|---|
| 712,640 | 11/1902 | Betts . | |
| 1,315,660 | 9/1919 | Ferguson . | |
| 2,010,870 | 6/1934 | Lindblad | 75/99 |
| 2,349,697 | 5/1944 | Bierly | 75/99 |
| 2,981,595 | 4/1961 | Tuwiner . | |
| 3,419,355 | 12/1968 | von Stein . | |
| 3,658,510 | 4/1972 | Hoffman et al. . | |
| 4,047,939 | 9/1977 | Morrison . | |
| 4,094,668 | 6/1978 | Yannopoulos et al. . | |
| 4,163,046 | 7/1979 | Subramanian et al. . | |
| 4,229,270 | 9/1980 | Subramanian et al. | 204/109 |
| 4,293,332 | 9/1981 | Wang et al. | 75/99 |

OTHER PUBLICATIONS

Safonov, V., "Chlorination of Copper-Nickel Anode Slimes in a Medium", Chem. Abs., vol. 75, 93960z.

Sargent, J. D., "Selenium Data", Bureau of Mines, I.C. 7715, 4/55, p. 7.

M. H. Merris & H. T. D. Binder, "Recovery of Selenium and Tellurium in Copper Refining", Engineering and Mining Journal, pp. 443–445 (Sep. 1918).

G. Charlot, Qualitative Inorganic Analysis (translation by R. C. Murray), p. 252 (1942), (p. 347 of 1969 French version also enclosed).

"The Operations and Plants of International Nickel Company of Canada Limited", Canadian Mining Journal 467, pp. 454–455 (May 1946).

J. H. Schloen & E. M. Elkin, "Treatment of Electrolytic Copper Refinery Slimes", Trans. of AIME, vol. 188, pp. 764–777 (May 1950).

F. S. Clements, "Twenty-five Years' Progress in Platinum Metals Refining", in the Industrial Chemist, pp. 345–354 (Jul. 1962).

B. H. Morrison, "Recovery and Separation of Selenium and Tellurium by Pressure Leaching of Copper Refinery Slime", from Unit Process in Hydrometallurgy, Met. Soc. Conf., vol. 24, pp. 227–249 (1963).

V. I. Dolgikh et al., "The Extraction Method of Recovery of Precious Metals from Sludges", Tsvetnye Metally, vol. 36, No. 11, pp. 85–86 (Nov. 1963).

P. H. Jennings et al., "A Hydrometallurgical Method for Recovering Selenium and Tellurium from Copper Refinery Slimes", AIME paper presented Feb. 25–29, 1968 in New York.

A. A. Kudryavtsev, "The Chemistry & Technology of Selenium and Tellurium", (Elkin Translation)(1974).

W. C. Cooper, Tellurium, Van Nostrand Reinhold Company, 1971 (Book).

R. A. Zingaro and W. C. Cooper, Selenium, Van Nos trand Reinhold Company, 1974 (Book).

*Primary Examiner*—John Doll
*Assistant Examiner*—Robert L. Stoll
*Attorney, Agent, or Firm*—Miriam W. Leff; Raymond J. Kenny

[57] ABSTRACT

A hydrometallurgical process is provided for separating heavy metal nuisance elements such as As, Sb, Bi, Sn and Pb from precious metals and/or selenium. The process can be used as a step in an overall hydrometallurgical process for treating refinery residues such as anode slimes for the separation and recovery of valuable metal values.

39 Claims, 2 Drawing Figures

HYDROMETALLURGICAL PROCESSING OF PRECIOUS METAL-CONTAINING MATERIALS

This is a continuation of application Ser. No. 304,264 filed Sept. 21, 1981.

This invention relates to a hydrometallurgical process for separating metal values, especially precious metals from less valuable metals. More particularly it relates to a method for separating heavy metal nuisance elements from platinum group metals, gold and selenium, e.g., for recovery of metal values from anode slimes and other refining residues, sludges and dusts containing such metals.

BACKGROUND OF THE INVENTION

Significant quantities of rarer elements tend to collect in intermediate refinery residues, sludges and dusts formed during the processing of ores, concentrates, mattes, etc., for recovery of their major valuable components. Minor metal components also collect with residual amounts of the major elemental components and are recovered from sludges accumulating in sulfuric acid plants. By refinery residues is meant materials such as anode slimes produced in the electrolytic refining of copper and nickel, accumulated impurities from the carbonyl treatment of nickel mattes to recover essentially pure nickel, dusts from roasting and smelting operations. While such residues vary widely in composition, they generally contain significant amounts of copper, selenium, tellurium, lead, silver, gold and some platinum group metals along with heavy metal nuisance elements such as arsenic, antimony, bismuth, tin and lead. Other elements that may be present are nickel and iron. Gangue components such as $Al_2O_3$, $SiO_2$, CaO are also usually present in the residues. The present process may also be used to separate metal values from other materials, such as precious metal catalysts that may have become contaminated during use. It will be apparent that whether a metal component is considered a major or minor component or an impurity depends on such things as concentration, ease of recovery, and economics with respect to precious metals, however, even when present as slight impurities, they may be cumulatively of great value when isolated and their presence may control the processing method the refiner selects.

Another determinative factor in treating residues for recovery of metals involves environmental considerations. For example, pyro- and vapormetallurgical steps may result in varying degrees of undesirable emissions containing, for examples, oxides of selenium, tellurium, sulfur, lead, and other heavy metals. Thus it is highly desirable to treat materials containing such metals by a route which reduces the amount of smelting operations, avoids steps which are most objectionable, and preferably is totally hydrometallurgical.

The present invention is described with particular reference to the treatment of anode slimes formed in the electrolytic refining of copper and nickel. Typical compositions of copper refinery slimes are given on pages 34–35 of SELENIUM edited by Zingaro. R. A. and Cooper, W. C., Van Nostrand Reinhold Company (1974). Approximate ranges (in wt. %) of selenium, tellurium, copper, nickel, lead, and precious metals are as follows: 2.8 to 80% copper, 1 to 45% nickel, 0.6 to 21% selenium, 0.1 to 13% tellurium, 1 to 45% silver, 0.3 to 33% lead, up to 3% gold and minor amounts platinum group metals. Gangue components such as $Al_2O_3$, $SiO_2$ and CaO are present in the amount of about 2 to 30%.

Generally, in conventional processes the anode slimes are first sequentially treated for the removal of copper, nickel, selenium and tellurium. One of the particularly difficult problems is the extraction of silver and other precious metals, which may be bound up in the slimes and at intermediate processing stages in compounds with selenium and/or tellurium. One widely used technique for the recovery of precious metals from slimes is to form a Dore metal, which is a precious metal ingot obtained by smelting the residue previously treated for the removal of copper, nickel, selenium and tellurium. The Dore metal is electrorefined for silver recovery, and the slimes obtained in electrorefining of silver can be further treated for the recovery of gold and platinum group metals. Dore smelting, however, is often regarded as the most expensive and complicated step of slimes treatment processes. Also, it can produce harmful emissions, e.g., of selenium, arsenic, lead and antimony oxides. In co-pending U.S. application Ser. No. 26,302, a method is disclosed for treating anode slimes and similar types of materials for the recovery of valuable components, particularly silver by a hydrometallurgical technique.

In accordance with the aforesaid pending application materials such as anode slimes are treated by a method comprising: converting silver values comprising silver compounds of selenium and/or tellurium to a material containing silver in a form readily leachable in dilute nitric acid, leaching such silver-containing material with dilute nitric acid, and recovering silver from such leach solution by electrowinning. Preferably the silver values are converted to at least one of the species elemental silver, a silver oxide and silver carbonate. Silver sulfide is a less desirable species since it is not as readily converted to the nitrate. Depending on various factors such as the composition of the feed, cost, location and availability of reagents and fuel, different processing routes may be taken to separate silver from other valuable components and to remove one or more impurities. The pretreatment route is not critical to the invention so long as the silver species obtained is leachable in dilute nitric acid. Preferably the overall process is hydrometallurgical and the initial treatments may be in an acid or base medium, as explained more fully in the co-pending application.

Many methods for separating and recovering various other components from the slimes have been proposed. For example, U.S. Pat. No. 4,163,046 discloses a hydrometallurgical route for the recovery of commercially pure selenium involving a caustic oxidative pressure leach, neutralization, sulfide treatment and acidification to obtain an essentially precious metal-free, tellurium-free selenium solution from which selenium is precipitated using $SO_2$ in the presence of the alkali metal halide and ferrous ion.

U.S. Pat. No. 2,981,595 shows a step in a process for recovery of tellurium from slimes in which a sulfuric acid solution containing copper and tellurium in sulfate form is treated with metallic copper to cement tellurium from the solution. It is also known to separate silver from copper and from lead and other elements such as antimony and arsenic by the use of chlorine gas. U.S. Pat. No. 712,640 uses this technique for the treatment of anode residues produced in the electrolytic refining of lead. It has also been shown that gaseous chlorine breaks down slimes constituents in aqueous medium at room temperature. Acid oxidative pressure leaching of raw slimes is one of the known techniques for separating selenium and tellurium. At an AIME Meeting in 1968 a hydrometallurgical method was reported for treating copper refinery slimes included a pressure leach of slimes in dilute sulfuric acid at 110° C. under 50 psi oxygen pressure to dissolve all of the copper and most of the tellurium, with cementation of the tellurium from solution with copper shot.

While each of the techniques mentioned above has useful aspects, none of them or processes which employ such technique is completely satisfactory. Problems arise not only because of the requirements, e.g. desired purity of particular end products, but also because of compositional peculiarities of the residues which are treated.

In the present method the material treated contains selenium, silver and also contains at least one other precious metals other than silver, such as gold or a platinum gold metal, e.g. platinum, palladium rhodium and ruthenium, and at least one nuisance element such as bismuth, lead, tin, arsenic and antimony. As indicated above, the material may also contain copper, nickel, tellurium, and gangue minerals such as $SiO_2$ or $Al_2O_3$. One of the problems in treating such materials is the separation of the nuisance elements from the more valuable components in an environmentally sound manner. Where the levels of palladium and/or platinum are high, difficulties arise if these metals report to the silver electrowinning phase of the process.

It is an object of the present invention to treat precious metal containing streams which also contain selenium and nuisance elements to separate the component elements in an environmentally sound manner. A further object is to carry out the overall process for recovery of such components using hydrometallurgical techniques. Another object is to separate nuisance elements from precious metals in a simple effective hydrometallurgical manner. Still another object is to separate and recover selectively selenium, platinum group metals, gold and silver from material which also contains nuisance elements. A further object is to recover a large fraction of the gold in the feed in substantial pure form and to recover selenium and/or tellurium in forms suitable for commercial sale. Another object is to achieve high recoveries of the metal values.

BRIEF DESCRIPTION OF DRAWINGS

The accompany drawings are flow sheets illustrating a process in accordance with the present invention.

INVENTION

Figure 1:
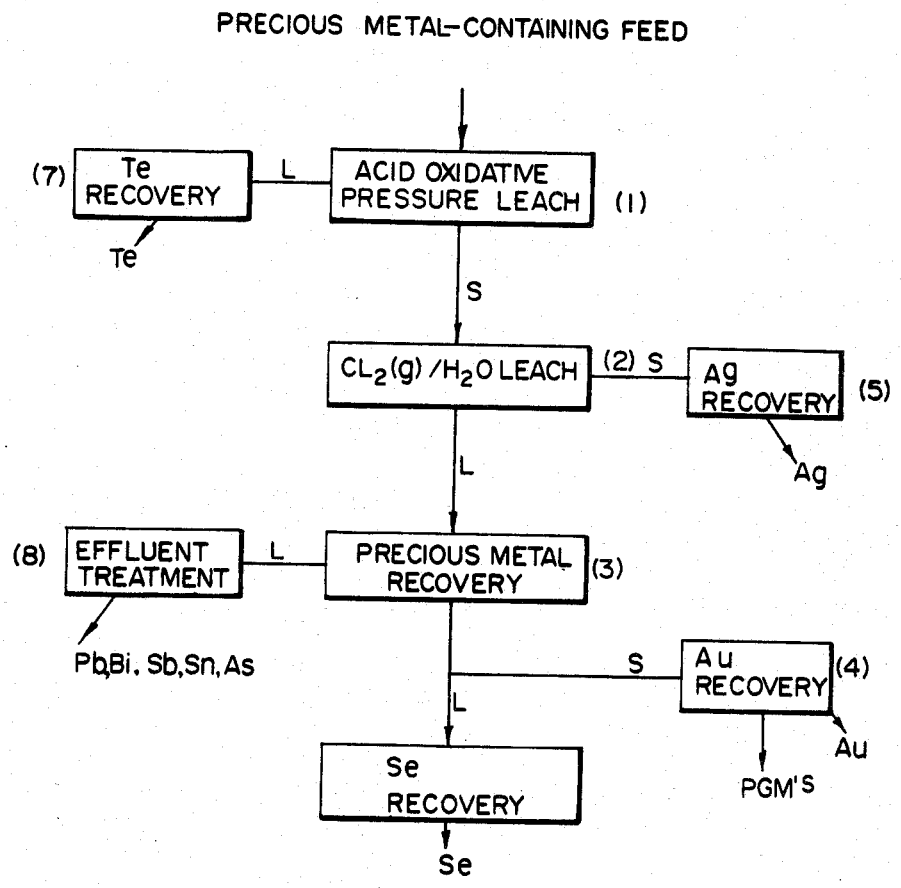
FIG. 1 is a simplified flow sheet which shows the relationship between the circuits in an embodiment which illustrates an overall hydrometallurgical process in accordance with the present invention.

In accordance with one aspect of the present invention a hydrometallurgical process is provided for treating a feed comprising an aqueous acidic solution containing dissolved therein one or more precious metals selected from the group, platinum group metals and gold and one or more of the nuisance elements bismuth, lead, tin, arsenic and antimony, to separate the precious metals from the nuisance elements comprising:

(a) treating the aqueous acidic solution with sulfur dioxide in the presence of selenium and a halide to reduce and precipitate selectively selenium and precious metals, and (b) separating the precipitated components from the remaining solution; thereby separating selenium and precious metals from the nuisance elements.

For effective recovery of precious metals, the selenium to precious metals weight ratio in the feed is typically about 0.5 to about 5 of selenium to 1 precious metals. The selenium:precious metals ratio may range below 0.5:1. However below 0.5, the precious metals precipitation is too low and/or takes too long. Preferably, in the presence of about 100 g/l chloride, the ratio is about 1 selenium:1 precious metals. To assure efficient precipitation of the precious metals, a $SO_2$ reduction is carried out in the presence of a halide, preferably chloride. In order to achieve complete precipitation of, especially, platinum, the $Cl^-$ level (total in solution) should be at or below 100 g/l. The reaction is carried out at about 70° C. to about 100° C., with sufficient $SO_2$ to reduce the metal values to be precipitated.

An advantage of using the $SO_2$ treatment of the solution which contains selenium, platinum group metals and nuisance elements, is that it provides a simple method of separating the nuisance elements from the valuable metal values. $SO_2$ is known to reduce selenium compounds such as selenites to elemental selenium, but it was surprising that, for example, platinum could be reduced with $SO_2$. $SO_2$ is generally regarded as a mild reducing agent which does not reduce platinum group metal salts, as indicated on page 252 of R. C. Murray's translation of G. Charlot's Qualitative Inorganic Analysis (1942). And, in fact, the $SO_2$ does not reduce other heavy metals such as bismuth, antimony, tin, arsenic and lead, the so-called nuisance elements present as chlorides, in the process of the present invention. Because of this selective reduction it is possible to separate the valuable metals from the nuisance elements. It is believed that in the event selenium is introduced in solution, e.g. in the feed, the elemental selenium produced by the action of $SO_2$ serves as a catalyst for the reduction of the platinum group metals. The recognition that $SO_2$ could be used to selectively reduce selenium and precious metals in the presence of the nuisance elements has the practical advantage of permitting the incorporation of this separation step in the processing of such materials as anode slimes at an optimum processing stage from the standpoint of effectiveness and cost. Heretofore, smelting was relied on the elimination of the nuisance elements.

Other advantages are that overall hydrometallurgical route can be used for separating the platinum group metals and gold from silver, recovery of commercially pure selenium can be carried out effectively, and a relatively pure precious metal and gold concentrate that is very suitable for further refining to the pure metals can be made. (A concentrate can be obtained which is substantially free of impurities except for some tellurium, and the tellurium is totally and readily soluble in $HCl—Cl_2$).

In accordance with another aspect of the invention an aqueous slurry comprising silver, selenium, at least one platinum group metal, and one or more of the group tellurium, nickel, copper, gold, and one or more of the nuisance elements bismuth, lead, arsenic, tin, and antimony, is treated for the separation of silver from the remaining platinum group elements and for the separation of the nuisance elements from platinum group elements and selenium by an overall hydrometallurgical process comprising:

(a) treating the aqueous slurry with chlorine gas to separate silver from platinum group metals and selenium (and tellurium if present) at a temperature in the range of about 40° to 95° C., the silver remaining in the residue as silver chloride and the other metal values being extracted in the chlorine leaching liquor;

(b) separating the silver-containing residue from the chlorine leach liquor;

(c) treating the separated chlorine leach liquor with $SO_2$ gas to precipitate selenium and platinum group metals, the nuisance elements remaining in solution; and (d) separating the resultant precipitate from the $SO_2$ treatment from the solution.

If copper and/or tellurium are present in the initial charge material, to separate the copper and tellurium from the other metal values in the charge, prior to the treatment with $Cl_2$ gas the slurry may be subjected to a mild acid oxidative pressure leach, e.g. at a temperature of about 100 to about 130° C. under about 30 to about 100 psi air pressure in dilute sulfuric acid (about 5 to 25 weight % $H_2SO_4$ in solution). More extreme conditions could be used but would be more expensive and could dissolve selenium.

To separate the platinum group metals from selenium, the separated residue of the $SO_2$ treatment may be subjected to an alkali metal hydroxide (e.g. NaOH) pressure leach typically at a temperature of about 200° C. and a pressure of about 300 psi at a pH greater than 8.

Recovery of metals or metal values can be effected by any conventional method. The method chosen may depend, for example, on the desired purity of the end product, cost, proximity to reagents, environmental considerations, and the composition. In one embodiment of the present invention, for example, silver is recovered from the chlorine leach residue by electrowinning, e.g. using the method described in the aforementioned U.S. application Ser. No. 26,302, which is incorporated herein by reference and made a part hereof. Recovery of selenium in commercially pure selenium can be effected using an adaptation of the caustic leach, neutralization and $SO_2$ reduction steps of the aforesaid U.S. Pat. No. 4,163,046, which is incorporated herein by reference and made a part hereof. Incorporation of the steps for recovery of commercially pure selenium into the process of the present invention is particularly effective since the selenium fraction can be highly concentrated. This means that the equipment size requirement for the selenium circuit can be lowered.

Copper, nickel, tellurium, platinum group metals also can be recovered by techniques well known to those skilled in the art.

The invention can be more easily understood by reference to the accompanying flow sheets which illustrate an embodiment of the present invention in which the precious metal (PM) containing feed is derived from a combination of refinery residues, of which coppery refinery anode slimes constitutes the major proportion. The feed consists, by weight, of approximately 8 to 38% copper, 4 to 10% nickel, 7 to 20% selenium, 1 to 5% tellurium, 7 to 14% silver, 0.1 to 0.4% gold, 1 to 4% platinum group metals (such as Pt, Pd, Rh, Ru, Ir), 0.1 to 0.2% antimony, 0.2 to 0.7% bismuth, 0.1 to 0.8% tin, 0.4 to 50% $SiO_2$, 0.3 to 2% arsenic and 2 to 10% lead. The particle size of components of the slurry ranges from about +10 to about −325 mesh. However, much larger particles are often present such as 1-5 mm pebbles. Preferably the feed contains Se:PM's in the ratio of about 1:1.

Referring to the simplified flow sheet of FIG. 1 which gives the relationship of the various steps and circuits of an embodiment of this invention and to the more detailed flow sheet of FIG. 2, the feed stream can be processed as follows:

Mild Acid Oxidative Pressure Leach—Circuit 1

The purpose of this step is to extract copper and tellurium. The residue is slurried in dilute $H_2SO_4$, e.g. 180 g/l $H_2SO_4$ at a temperature of about 100° to 120° C. e.g. 105° C., under atmospheric pressure up to about 70 to 100 psig air, e.g. 80 psig air. The solids content of the slurry may range from about 5 to 10 to about 20 or 25% e.g. about 15%. The precious metals, selenium and nuisance elements remain in the residue. Following a liquid/solid separation, the residue is treated in Circuit 2.

The principal reactions which occur in Circuit 1 are:

$$Cu^{\circ} + H_2SO_4 + 1/2O_2 \rightarrow CuSO_4 + H_2O$$

$$Cu_2Se + 2H_2SO_4 + O_2 \rightarrow 2CuSO_4 + Se^{\circ} + 2H_2O$$

$$Cu_2Te + 2H_2SO_4 + 2O_2 \rightarrow 2CuSO_4 + H_2TeO_3 + H_2O$$

It was found that satisfactory extraction of copper and tellurium could be achieved in 5 hours in a batch-type operation at 105° C. and 80 psig air. Air is preferred to $O_2$ as the oxidant since using $O_2$ increases selenium extraction.

The operation can be carried out in a stainless steel autoclave and can be run as a batch or continuous process.

Washing of the residue is important to prevent copper from reporting to the precious metal (PM) circuit, and following a liquid/solid separation (L/S) (e.g. by filtration) the residue from Circuit 1 is treated in Circuit 2 and the acid leach liquor is treated in Circuit 7.

Circuit 1 is optional. For example, if no tellurium and copper are present in the feed, Circuit 1 and Circuit 7 may be omitted.

Chlorine Leaching—Circuit 2

The purpose of the chlorine leach is to separate silver from the other precious metals (such as platinum group metals and gold) and from selenium. The decopperized, detellurized residue is treated as an aqueous slurry containing about 200 g/l to 450 g/l solids, e.g. about 350 g/l, with chlorine, e.g. by metering chlorine gas into the slurry. The chlorine leaching is carried out at a temperature of about 50° C. to about 90° C. and at substantially atmospheric pressure. Heat is released by the reaction so that it is necessary to cool the system. The chlorine leaches from the residue from step 1: precious metals other than silver, selenium, residual tellurium, lead and other heavy metal contaminants such as bismuth, arsenic, antimony and tin. Silver remains in the chlorine leach residue as silver chloride. Silica also remains in the residue.

The principal reactions in the chlorine leach operation are:

$$Se^{\circ}+3Cl_2+4H_2O \rightarrow H_2SeO_4+6HCl$$

$$S^{\circ}+3Cl_2+4H_2O \rightarrow H_2SO_4+6HCl$$

$$Pt+2Cl_2+2HCl \rightarrow H_2PtCl_6^{*}$$

$$PbSO_4+2HCl \rightarrow H_2SO_4+PbCl_2$$

$$Ag_2Se+4Cl_2+4H_2O \rightarrow 2AgCl+H_2SeO_4+6HCl$$

*Other precious metals than silver also dissolve.

The reaction is carried out for a sufficient length of time to maximize extraction. At a temperature of about 60° C. and about 30 cm of water overpressure of $Cl_2$, about 6 hours is sufficient time to maximize the extraction of precious metals (other than silver) selenium and other metal values from the decopperized, detellurized residue. Extractions of about 99.5% platinum, palladium and gold, about 97% rhodium, ruthenium and iridium, and about 99% selenium can be obtained. A relatively low temperature, e.g. below about 80° C. avoids the use of more expensive corrosion resistant equipment.

One of the objects of the chlorine leach is to separate the heavy metal contaminants from silver. Sufficient HCl should be present, e.g. from S or Se oxidation to give total dissolution of the lead. To avoid precipitation of $PbCl_2$ the resultant chlorine leach liquor should be filtered hot (above about 60° C.). A sodium chloride wash solution may be used to insure complete lead removal from the filter cake.

If for any reason gold precipitates, e.g. on standing, the solution should be rechlorinated to redissolve the gold.

The chlorine leach solution is separated from the silver-containing chlorine leach residue, e.g., by filtration, the residue washed several times, the chlorine leach liquor is treated in Circuit 3 for precious metals recovery and the chloride leach residue is treated in the silver recovery Circuit 5.

Precious Metal Recovery—Circuit 3

The purpose of this circuit is to separate base metals including heavy metal contaminants from precious metals, selenium and tellurium (residual) and to recover precious metals. The precious metal circuit comprises: (a) reduction with $SO_2$, (b) a caustic oxidative pressure leach, (c) sulfuric acid leach, (d) cementation of the sulfuric acid leach, and (e) precious metal recovery. In the first step of the precious metal recovery circuit the chlorine-water leach liquor is treated with $SO_2$ to separate the heavy base metal including the nuisance elements from the precious metals. The $SO_2$ selectively reduces and precipitates the selenium and precious metals. The separated solids are pressure leached with caustic and $O_2$ to extract selenium. The caustic leach liquor is acid leached with dilute sulfuric acid to remove residual copper and tellurium (which may be removed from the sulfuric acid leach liquor by cementation) and to provide a bulk precious metal concentrate for separation and refining of precious metals. The steps of the precious metal recovery circuit are:

(a) $SO_2$ Treatment. The chlorine leach liquor is treated at about 80° C. to about 100° C., e.g. 95° C., with $SO_2$ metered in sufficient quantity to reduce metal values to be precipitated from the liquor, e.g. precious metals, selenium and tellurium. About 6 hours retention time are required for reduction of selenium and precious metals in a batch system. Cooling coils may be used to remove heat of reaction. It is important to adjust $Cl^-$ concentration to 100 g/l or efficiency of platinum reduction is lowered.

The precipitate containing the precious metals and selenium is separated from the base metal liquor, e.g. by pressure filtration in a filter press or vacuum filter, and the precious metal and selenium containing residue is washed several times using a chloride solution, e.g. NaCl.

The principal reactions in the $SO_2$ reduction step are:

$$H_2SeO_4+3SO_2 2H_2O \rightarrow Se+3H_2SO_4$$

$$H_2PtCl_6+H_2SeO_4+5SO_2+6H_2O \rightarrow PtSe+5H_2SO_4+6HCl, \text{ etc.}$$

As indicated above it was surprising that the precious metals were reduced by $SO_2$. It is believed that this reaction occurs because of the presence of selenium formed by the reaction of $SO_2$ in $H_2SeO_4$. The selenium, in turn, acts as a catalyst for the $SO_2$ reduction of precious metals in solution. The Se:PM weight ratio should be typically about 0.5 to about 5 Se:1 PM, e.g. about 1 to 3:1. The chloride level does not appear to be as critical at a Se:PM ratio of about 1:1 as at the higher and lower limits. For example, at a Se:PM ratio of about 1:1, the chloride level may be higher, e.g. about 160 g/l, with good precious metal recovery at the lower and higher limits, e.g. about 0.5:1 Se:PM and above about 2 or 3:1 Se:PM the chloride level is preferably about 50 g/l. Preferably, e.g. in the presence of about 100 g/l chloride the Se:PM weight ratio is about 1:1. If the selenium to precious metal ratio is not sufficiently high, or if the $Cl^-$ concentration is too high, too large a percentage of the precious metals particularly platinum will report to the scavenger circuit and recovery will not be as good.

Filtration to separate the dissolved base metals from the precipitated precious metals and selenium values is carried out hot, e.g. at about 30° to about 95° C., typically about 80°-90° C., to prevent lead from precipitating. This separation of the nuisance elements from the precious metals is a very desirable feature of this step. Some iridium is left in solution. The precious metal and selenium containing residue is treated by caustic pressure leaching and the base metal containing liquor is treated in Circuit 8.

(b) Caustic Oxidative Leaching. The filter cake from the $SO_2$ reduction step is slurried in caustic solution to 100 to 250 g/l solids, e.g. 200 g/l solids. The NaOH is used in excess of stoichiometric to selenium, e.g. 40 g/l excess. A caustic pressure leach is carried out at 180° to 220° C. e.g. 200° C. at a total pressure of 250 to 350 psig, e.g. 300 psig. The $O_2$ partial pressure is about 50 to 100 psi, and preferably greater than 50 psi. Preferably, sufficient oxygen is provided to oxidize selenium and tellurium to the hexavalent state.

Assuming selenium and tellurium in the elemental state, the principal reactions of the caustic pressure leach step are:

$$Se^{\circ}+2NaOH+3/2O_2 \rightarrow Na_2SeO_4+H_2O$$

$$Te^{\circ}+2NaOH+3/2O_2 \rightarrow Na_2TeO_4+H_2O$$

Selenium is dissolved. Residual tellurium remains in the caustic leach residue with the precious metals. To insure low tellurium contamination of the selenium, care should be taken to completely oxidize tellurium to $Na_2$-

$TeO_4$. At about 200° C. and 300 psig total pressure complete oxidation of the tellurium is achieved in about 5 hours in a batch process.

Alternatively the bulk of the selenium and the residual tellurium can be extracted under milder conditions, i.e. at temperatures below 180° C. and/or at lower pressures than 250 psig, e.g. at about 80° to 100° C. and at atmospheric pressure.

The caustic leach liquor is separated from the precious metals containing residue, e.g. by pressure filtration and the washed residue is leached with sulfuric acid.

(c) Sulfuric Acid Leaching. The caustic oxidative leach residue is leached with dilute sulfuric acid to remove residual copper and tellurium and provide a precious metal concentrate.

In this step the filter cake from the caustic oxidative pressure leach is slurried to about 100 to about 300 g/l solids, e.g. 250 g/l solids, and $H_2SO_4$ is added to a pH of about 1.5 to 2 e.g. about 1.5. The sulfuric acid leach is carried out at about 40° C. to about 80° C., e.g. about 60° C. At a temperature of about 60° C. and atmospheric pressure and $H_2SO_4$ added to pH=1.5, and 2 hours are required for extraction of copper and tellurium that will leach.

The principal reactions of the dilute sulfuric acid leach step are:

$$Na_2TeO_4+H_2SO_4\rightarrow H_2TeO_4+Na_2SO_4$$

$$Cu(OH)_2+H_2SO_4\rightarrow CuSO_4+2H_2O$$

The dilute sulfuric acid leach residue which contains the bulk of the precious metals are separated from the liquor which contain tellurium, copper, and some rhodium and palladium which dissolve, e.g. by filtration. The precious metal concentrate is treated for recovery of the precious metals, e.g. as shown in Step e of the precious metal recovery circuit, and the liquor can be treated by cementation and recycle as shown in Step d below.

(d) Cementation of Dilute Sulfuric Acid Leach Liquor. The resultant dilute sulfuric acid leach liquor is cemented with iron powder to precipitate metals such as tellurium, copper, rhodium, and palladium from solution. The resultant slurry may be recycled to Circuit 1. Cementation is carried out at an elevated temperature, e.g. about 70° C. to about 90° C., typically 80° C. at atmospheric pressure.

The principal reactions in this cementation step are:

$$H_2TeO_4+3Fe+3H_2SO_4\rightarrow Te+3FeSO_4+4H_2O$$

$$CuSO_4+Fe\rightarrow Cu+FeSO_4$$

In recycling the slurry the copper and tellurium will be extracted in Circuit 1, and the rhodium and palladium should report to the chlorine leach liquor.

(e) Precious Metal Recovery from Concentrate. The residue of the dilute sulfuric acid leach which contains the bulk of the precious metals may be treated for removal of gold as set forth in optional Circuit 4, or gold may be recovered in conjunction with precious group metals refining as described below. The remainder of the precious metals, mainly platinum group metals can be recovered using standard or known techniques—which recovery is not a part of the present process. For example, the concentrate may be dissolved in aqua regia, and gold, platinum and palladium may be sequentially precipitated using $FeSO_4$, ammonium chloride and ammonium hydroxide/hydrochloric acid. Details of a suitable process can be found in F. S. Clements' THE INDUSTRIAL CHEMIST, Vol. 38 (July 1962).

Although all steps in the Precious Metal Circuit noted above are carried out using batch techniques, continuous processing techniques may also be employed, with appropriate adjustments in parameters.

Gold Recovery—Circuit 4

Gold, if present, can be recovered from the $Cl_2$ leach solution before the $SO_2$ reduction step of Circuit 3. Preferably, it is selectively removed from the precious metal concentrate by leaching with HCl—$Cl_2$ and then extracting the dissolved gold by solvent extraction, e.g. with diethylene glycol dibutyl ether. The loaded solvent is scrubbed with HCl to remove any entrained aqueous phase that might carry impurities, and finally the gold is reduced with oxalic acid. Using this technique high purity gold can be produced.

Silver Recovery—Circuit 5

The purpose of this circuit is to recover metallic silver of commercial purity from the chlorine leach residue of Circuit 2. The silver chloride in the $Cl_2$ leach residue is first converted to silver oxide ($Ag_2O$), i.e. a form soluble in dilute nitric acid. Techniques for recovery of silver by electrowinning from dilute nitric acid are disclosed in the aforementioned co-pending U.S. application Ser. No. 26,302. For example, the silver chloride may be converted to silver oxide by caustic digestion, e.g. at 60°-95° C. and atmospheric pressure, and after leaching of the separated residue in dilute nitric acid (e.g. at 80° C. at atmospheric pressure) and (optionally) purification of the solution, the silver can be recovered by electrowinning.

Figure 2:
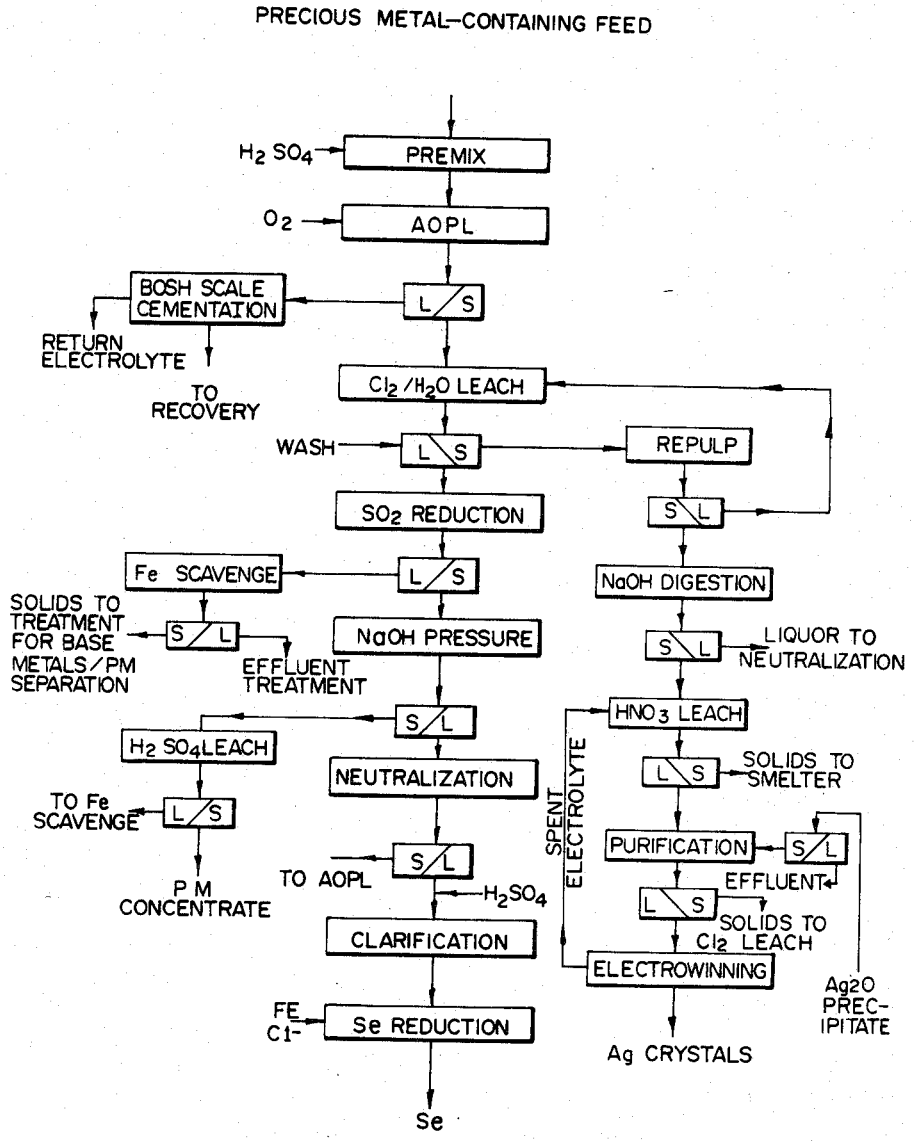
FIG. 2 is a more detailed flow sheet than FIG. 1 which shows a preferred embodiment of the present invention.

As shown in FIG. 2, the residue of the chlorine leach is preferably repulped in fresh caustic (e.g., 200 g/l solids in 400 g/l NaOH solution) and refiltered, with the caustic used for repulping being used for the next caustic digestion.

Typically electrowinning of silver from dilute nitric acid solution can be effected at a temperature in the range of about 30° C. to about 50° C., e.g. 40° C., at a current density of 150–400 amps/$m^2$.

Selenium Recovery—Circuit 6

The purpose of this step is to produce saleable selenium. Commercially pure selenium can be obtained using a neutralization and $SO_2$reduction technique of the aforementioned U.S. Pat. No. 4,163,046.

The caustic pressure leach liquor step of Circuit 3 contains $Na_2SeO_4$ at high concentration. After neutralization with sulfuric acid and treatment to precipitate and remove traces of precious metals, the solution is acidified with $H_2SO_4$ and then treated with $SO_2$ gas to precipitate selenium.

Neutralization (to a pH of 7 to 9) with $H_2SO_4$ carried out at a temperature of about 40° C. to about 80° C. typically 60° C. and atmospheric pressure. The precious metals, which are precipitated during the neutralization step, e.g. with a sulfide such as NaSH, may be returned to the $Cl_2$ leach circuit. The liquor from the neutralization step is acidified with sulfuric acid to about 70 to 200 g/l, typically 100 g/l at a temperature of about 40° C. to about 80° C., typically 60° C., and atmospheric pressure. Any precipitate which forms, e.g. of $PbSO_4$, should be removed to avoid contamination of the selenium product. The selenium values in acidified solution are then reduced with $SO_2$ in the presence of $Fe^{2+}$ and $Cl^-$.

Tellurium Recovery—Circuit 7

The purpose of this step is to recover tellurium.

The solution from the acid oxidative pressure leach Circuit 1 contains tellurium and a small amount of selenium, together with copper, nickel, some arsenic, iron and cobalt. Tellurium and selenium are removed from solution, e.g., by cementation with Bosh scale or metallic copper or iron, according to known techniques. Solution may be returned to a copper electrowinning circuit for recovery of copper. The $Cu_2Te$ cement (in case of copper cementation) is caustic leached under oxidizing conditions and then $Na_2TeO_3$ solution is neutralized with $H_2SO_4$ to precipitate $TeO_2$. The $TeO_2$ may be marketed or, e.g., elemental tellurium may be recovered. Preferably, the tellurium is electrowon from a caustic electrolyte.

The particular method used for recovery of tellurium is not a part of this process.

Scavenging and Effluent Treatment—Circuit 8

The purpose of this step is to clean up effluent streams. In the embodiment of FIG. 2 there are three main liquid streams that are treated prior to discharge:

(1) Liquor from $SO_2$ reduction in precious metal recovery Circuit 3, containing HCl, $H_2SO_4$, nuisance elements such as Bi, Sb, Sn and Pb, and also containing Ir (which must be recovered) and other precious metals not reduced in the precious metals recovery circuit.

(2) Caustic solution from the silver circuit containing sodium silicate and sodium chloride.

(3) Barren solution from the selenium recovery circuit containing $H_2SO_4$, $FeSO_4$, NaCl and traces of Se.

Other waste streams are also treated such as $NaNO_3$ solution from the silver circuit and floor wash liquors.

Known methods can be used for treating these streams. Iron powder may be used to reduce precious metals or selenium as they occur in waste streams 1 and 3.

In accordance with the present invention iridium and other precious metals may be recovered from the scavenging precipitate. For example, to recover iridium after reduction with Fe° powder, the solids are redissolved (into a much smaller volume, i.e. instead of 20,000 liters redissolve in 1000 liters aqueous acid solution) and the solution treated with thiourea, which precipitates iridium, but not arsenic, bismuth or antimony. Copper and selenium do precipitate with other precious metals. This precipitate is recycled.

After the scavenging precipitate is treated for recovery of iridium and othr precious metals present, and the barren solution containing arsenic, bismuth, lead, etc. is combined with the solution from iron scavenging and stream 2 and neutralized, e.g. by adding lime or acid, as required. Aeration may be required to ensure the oxidation of iron and the formation of ferric arsenate.

It will be appreciated that the reactions which occur at each step of the process described above are quite complicated. The reactions shown above for each circuit are considered to be the principal overall reactions.

Although the present invention has been described in conjunction with preferred embodiments, it is to be understood that modifications and variations may be resorted to without departing from the spirit and scope of the invention, as those skilled in the art will readily understand. Such modifications and variations are considered to be within the purview and scope of the invention and appended claims.

We claim:

1. A process for treating an aqueous slurry comprising silver, selenium, at least one precious metal selected from the platinum group metals and gold, at least one of the group tellurium, nickel and copper, and at least one of the nuisance elements bismuth, lead, arsenic, tin and antimony, to separate silver from precious metals and to separate nuisance elements from precious metals and selenium comprising:

(a) subjecting the aqueous slurry to a acid oxidative leach in sulfuric acid;

(b) separating the resultant liquor of the acid oxidative leach from the remaining residue;

(c) treating an aqueous slurry of the remaining residue of the acid oxidative leach with chlorine gas to separate silver from platinum group metals and selenium at a temperature in the range of about 40° to 95° C., the silver remaining in the residue as silver chloride and other metal values being extracted in the chlorine leach liquor;

(d) separating the silver-containing residue from the chlorine leach liquor;

(e) treating the separated chlorine leach liquor with $SO_2$ gas to precipitate selenium and platinum group metals; the nuisance elements remaining in solution;

(f) separating the resultant precipitate of the $SO_2$ treatment from the solution;

(g) subjecting the resultant leach residue of the $SO_2$ treatment to a caustic oxidative leach treatment to extract selenium and separate it from precious metals remaining in the caustic leach residue; and (h) subjecting separated residue from the caustic oxidative leach treatment to a sulfuric acid leach treatment to leach basic metals from a precious metal containing residue.

2. A process for treating a feed comprising an aqueous acidic chloride leach solution containing selenium, one or more precious metals selected from the group platinum group metals and gold, and one or more of the nuisance elements bismuth, lead, tin, arsenic and antimony, to separate the precious metals and selenium from the nuisance elements comprising treating the aqueous solution with sulfur dioxide gas in the presence of a halide to reduce and precipitate selectively the selenium and precious metals, said precipitated components comprising the residue of the $SO_2$ treatment, separating the residue from the remaining solution, thereby separating selenium and precious metals from the nuisance elements, and subjecting the $SO_2$ treatment residue to a caustic oxidative leach to extract selenium and separate it from precious metals remaining in the residue.

3. A process according to claim 2, wherein the treatment with $SO_2$ is carried out at a temperature of about 70° C. to about 100° C. at substantially atmospheric pressure.

4. A process according to claim 2, wherein the selenium content of the solution is adjusted so that the selenium and precious metals are present in the weight ratio of about 0.5 to about 5 selenium to 1 precious metals.

5. A process according to claim 2, wherein the selenium content of the solution is adjusted so that the solution contains selenium and precious metals in a weight ratio of about 1:1.

6. A process according to claim 2, wherein separation of the resultant product of the $SO_2$ treatment is carried out at an elevated temperature to prevent lead from precipitating.

7. A process according to claim 6, wherein the separation is carried out at a temperature of about 30° C. to about 95° C.

8. A process according to claim 6, wherein separation is by filtration carried out at about 80° C. to about 90° C.

9. A process according to claim 2, wherein the feed comprises platinum and the halide is a chloride, and wherein the chloride concentration does not exceed about 100 grams per liter.

10. A process according to claim 2, wherein the caustic oxidative leach is carried out at a temperature of about 180° to about 220° C. and at a pressure of about 250 to about 350 psig.

11. A process for treating an aqueous slurry derived from a feed residue comprising at least one of the group selected from refinery or manufacturing residues, sludges and dusts and comprising silver, selenium, at least one precious metal selected from platinum group metals and gold, at least one of the group tellurium, nickel and copper and at least one of the nuisance elements bismuth, lead, arsenic, tin and antimony, to separate silver from precious metals and to separate nuisance elements from precious metals, comprising:

(a) treating the aqueous slurry with chlorine gas at a temperature in the range of about 40° to 95° C. to separate silver from platinum group metals and selenium, silver remaining in the residue as silver chloride and the other metal values being extracted in the chlorine leach liquor;

(b) separating the silver-containing residue from the chlorine leach liquor;

(c) treating the separated chlorine leach liquor with $SO_2$ gas to precipitate selenium and platinum group metals, the nuisance elements remaining in solution; and (d) separating the resultant precipitate of the $SO_2$ treatment from the solution;

whereby prior to any step for treating said feed residue selenium, precious metals and nuisance elements in the feed residue in said aqueous slurry are brought into solution and the nuisance elements are separated from the precious metals.

12. A process according to claim 8, wherein at least one of the group copper and tellurium is present in the feed residue and prior to treatment of the aqueous slurry of the feed residue with chlorine gas, the aqueous slurry is subjected to a mild acid oxidative pressure leach at a temperature of about 100° C. to about 120° C. under about 70 to about 100 psig air in dilute sulfuric acid to dissolve copper and tellurium values present in the feed residue and the copper and tellurium containing liquor is separated from the residue; whereby prior to any step for treating said feed residue, apart from said steps to remove copper and tellurium present in said feed residue, selenium, precious metals and nuisance elements in the feed residue are brought into solution and the nuisance elements are separated from the precious metals.

13. A process according to claim 8, wherein the separated silver containing residue is digested with caustic, the resultant residue is treated to dissolve silver in a dilute nitric acid solution and the silver is recovered from solution by electrowinning.

14. A process according to claim 12, wherein tellurium present in the aqueous slurry is recovered from the mild acid oxidative leach liquor by a method comprising cementation.

15. A process for treating an aqueous slurry derived from a feed residue comprising at least one of the group selected from refinery or manufacturing residues, sludges and dusts and comprising silver, selenium, at least one precious metal selected from platinum group metals and gold, at least one of the group tellurium, nickel and copper and at least one of the nuisance elements bismuth, lead, arsenic, tin and antimony, to separate nuisance elements from precious metals and selenium, comprising:

(a) treating the aqueous slurry with chlorine gas at a temperature in the range of about 40° to 95° C., to separate silver from platinum group metals, selenium and tellurium, silver remaining in the residue as silver chloride and the other metal values being extracted in the chlorine leach liquor;

(b) separating the silver-containing residue from the chlorine leach liquor;

(c) treating the separated chlorine leach liquor with $SO_2$ gas to precipitate selenium and platinum group metals, the nuisance elements remaining in solution;

(d) separating the resultant precipitate of the $SO_2$ treatment from the solution; and (e) subjecting the separated precipitate of the $SO_2$ treatment to a caustic oxidative leach treatment to extract selenium and separate it from the precious metals remaining in the caustic leach residue.

16. A process according to claim 15, wherein the caustic leach residue contains at least one of the group copper and tellurium and said caustic leach residue is subjected to a dilute sulfuric acid leach to extract said copper and tellurium.

17. A process according to claim 16, wherein the dilute sulfuric acid leach is carried out by slurrying the caustic leach residue to about 100 to about 300 g/l solids, adding sulfuric aicd to a pH of about 1.5 and said leach is carried out at a temperature of about 40° to about 80° C. and atmospheric pressure, to extract said copper and tellurium.

18. A process according to claim 17, wherein tellurium is present in the caustic leach residue and tellurium is extracted into the $H_2SO_4$ leach liquor and said $H_2SO_4$ leach liquor is treated to precipitate tellurium by cementation.

19. A process according to claim 16, wherein the residue of the dilute sulfuric acid leach is treated for recovery of precious metals.

20. A process according to claim 8, wherein gold and at least one platinum group metal are present in the feed residue, and wherein after treating the aqueous slurry of the feed residue with chlorine gas and prior to reduction with $SO_2$, gold is separated from the chlorine leach solution by solvent extraction and whereby prior to any step for treating said feed residue, apart from steps to remove gold and silver the nuisance elements are separated from the platinum group metals.

21. A process according to claim 11, wherein the residue of the $Cl_2$ leach is treated for recovery of silver by a method comprising repulping said $Cl_2$ leach residue, digesting the repulped residue with caustic, treating the caustic treated residue with dilute nitric acid, to extract silver values, and electrowinning silver from said dilute nitric acid solution.

22. A process according to claim 15, wherein the selenium recovered from the caustic leach liquor by a method comprising neutralizing the caustic leach liquor to a pH of about 7 to about 9 at a temperature of about 40° to about 80° C., precipitating precious metals from the neutralized liquor with a sulfide, and then reducing selenium values with $SO_2$.

23. A process for treating an aqueous slurry derived from a feed residue comprising at least one of the group selected from refinery or manufacturing residues, sludges and dusts and comprising silver, selenium, at least one precious metal selected from platinum group metals and gold, at least one of the group tellurium, nickel and copper and at least one of the nuisance elements bismuth, lead, arsenic, tin and antimony, to separate silver from precious metals and to separate nuisance elements from precious metals and selenium, comprising:

(a) treating the aqueous slurry with chlorine gas at a temperature in the range of about 40° to 95° C.,
(b) separating the residue from the chlorine leach liquor;
(c) treating the separated chlorine leach liquor with $SO_2$ gas to precipitate selenium and platinum group metals, the nuisance elements remaining in solution;
(d) separating the resultant precipitate of the $SO_2$ treatment from the liquor; and
(e) subjecting the resultant liquor from the $SO_2$ treatment of the chlorine leach liquor with iron powder to precipitate and remove any remaining precious metals and selenium prior to discharge of the liquor.

24. A process according to claim 23, wherein iridium present in said resultant liquor from $SO_2$ treatment of the chlorine leach liquor is precipitated by the iron powder, and said iridium is recovered by a method comprising redissolving the iridium-containing precipitate in an aqueous acid solution and treating the solution with thiourea.

25. A process for treating a feed residue comprising at least one of the group selected from refinery or manufacturing residues, sludges and dusts, said feed residue containing one or more precious metals selected from the group comprising platinum group metals and gold, and one or more nuisance elements selected from the group comprising bismuth, tin, arsenic, antimony and lead, to separate the precious metals from the nuisance elements comprising treating the feed residue to form an aqueous acidic solution containing nuisance elements and precious metals derived from said feed residue, adding selenium to the aqueous acidic solution, treating the aqueous acidic solution with sulfur dioxide in the presence of selenium and a halide to reduce and precipitate selectively selenium and precious metals, and separating the precipitated components from the remaining solution.

26. A process according to claim 9, wherein the selenium addition is sufficient to provide selenium in the aqueous acidic solution in the weight ratio of about 0.5 to about 5 selenium to about 1 precious metals.

27. A process according to claim 25, wherein the feed residue contains at least one of the group selected from copper, tellurium and silver, and wherein prior to treating the feed residue to form an aqueous acidic solution containing nuisance elements and precious metals derived from said feed residue, the feed residue is subjected to an acid leach; and whereby prior to any step for treating said feed residue, apart from said acid leach step, selenium, precious metals and nuisance elements in the feed residue are brought into solution and the nuisance elements are separated from precious metals.

28. A process according to claim 25, wherein the feed residue contains silver and wherein an aqueous slurry derived from said feed residue is treated with $Cl_2$ gas to dissolve precious metals and to separate them from silver, the silver remaining in the residue.

29. A process according to claim 26, wherein the feed comprises platinum and the halide is a chloride, and wherein the chloride concentration does not exceed about 100 grams per liter.

30. A process for treating a feed residue comprising at least one of the group consisting of a refinery residue sludge or dust formed during the processing of an ore, concentrate or matte and a sludge accumulated in sulfuric acid plants, said feed residue containing selenium and at least one precious metal selected from platinum group metals and gold, and at least one of the nuisance elements bismuth, lead, arsenic, tin and antimony, and containing at least one of the group copper, tellurium and silver, said process being carried out to separate said nuisance elements from said precious metals without previously subjecting said feed to a sulfatizing roast, comprising subjecting the feed residue to an aqueous acid leach, treating the resultant residue of said acid leach to form an aqueous acidic chloride solution containing nuisance elements and precious metals derived from the feed residue, adjusting the selenium content of the soluton so that it is present in a weight ratio to precious metals of about 0.5 to about 5 selenium to about 1 precious metals, treating the adjusted aqueous acidic chloride solution with sulfur dioxide to reduce and precipitate selectively the selenium and precious metals and separating the precipitated components from the remaining solution; whereby prior to any step for treating said feed residue, other than the above stated steps, precious metals and nuisance elements in the feed residue are brought into solution and the nuisance elements are separated from the precious metals.

31. A process according to claim 30, wherein the chloride level in aqueous acidic chloride solution does not exceed about 50 g/l when the selenium to precious metal ratio is about 0.5 to 1.

32. A process for treating anode slimes containing selenium, one or more precious metals selected from the group platinum group metals and gold, and one or more of the nuisance elements bismuth, lead, tin, arsenic and antimony, to separate the precious metals and selenium from the nuisance elements comprising treating the anode slimes to provide an acidic aqueous solution containing selenium, precious metals and nuisance elements of the slimes, and prior to any sulfatizing step treating said aqueous acidic solution with sulfur dioxide gas in the presence of a halide to reduce and precipitate selectively the selenium and precious metals, and separating the precipitated components from the remaining solution; whereby prior to any sulfatizing step for treating said anode slimes the nuisance elements are separated from the precious metals.

33. A process according to claim 1, wherein the feed residue further contains at least one of the group copper, tellurium and may contain silver and wherein prior to treating the feed residue to form said aqueous acidic solution containing said selenium, nuisance elements and precious metals the feed residue is subjected to an aqueous acid leach step; whereby prior to any step for treating said feed residue, apart from said aqueous acid leach step, selenium, precious metals and nuisance elements in the feed residue are brought into solution and the nuisance elements are separated from precious metals.

34. A process according to claim 33, wherein the feed residue containing silver and wherein the resultant residue of the aqueous acidic leach is treated to separate silver and dissolve precious metals, selenium and nuisance elements, whereby prior to any step for treating said feed residue, apart from said stated steps of claims 29 and 30, the nuisance elements are separated from the precious metals.

35. A process for treating a feed residue comprising at least one of the group selected from refinery or manufacturing residues, sludges and dusts, said feed residue containing selenium, one or more precious metals selected from the group platinum group metals and gold, and one or more of the nuisance elements bismuth, lead, tin, arsenic and antimony to separate precious metals from the nuisance elements comprising essentially of treating the feed residue to form an aqueous acidic solution containing selenium, nuisance elements and precious metals derived from said feed residue, adjusting the selenium content of the solution so that it is present in solution in a weight ratio of at least 0.5 selenium to 1 precious metals, treating the aqueous acidic solution with sulfur dioxide gas in the presence of a halide to reduce and precipitate selectively the selenium and precious metals, and separating the precipitated components from the remaining solution; whereby prior to any step for treating said feed residue selenium, precious metals and nuisance elements in the feed residue are brought into solution and the nuisance elements are separated from the precious metals.

36. A process according to claim 25, wherein the selenium addition is sufficient to provide the selenium in solution in a weight ratio of at least about 0.5 selenium to 1 precious metals.

37. A process according to claim 30 in which the chloride concentration is adjusted according to the selenium to precious metal ratio, the chloride level being up to 160 grams per liter when the Se:precious metal ratio is about 1:1 and at a Se:precious metal ratio below about 1:1 and above about 2:1 the chloride level is about 50 grams per liter.

38. A process according to claim 31, wherein the aqueous acidic solution is a chloride leach solution.

39. A process according to claim 31, wherein the halide is a chloride.

* * * * *